US005829061A

United States Patent [19]

Visgil et al.

[11] Patent Number: 5,829,061

[45] Date of Patent: Nov. 3, 1998

[54] WORK GLOVES

[76] Inventors: Jane T. Visgil; John D. Visgil, both of 17 Brookside Dr., Sewell, N.J. 08080

[21] Appl. No.: 833,672

[22] Filed: Apr. 8, 1997

[51] Int. Cl.[6] ..... A41D 19/00

[52] U.S. Cl. ..... 2/161.6; 2/163

[58] Field of Search ..... 2/161.6, 163, 164, 2/167, 168, 16, 21, 159

[56] References Cited

U.S. PATENT DOCUMENTS

| | | | |
|---|---|---|---|
| D. 106,139 | 9/1937 | Larom . | |
| D. 363,153 | 10/1995 | Brasseur . | |
| 2,185,720 | 1/1940 | Bialostok . | |
| 2,242,318 | 2/1941 | Mosier . | |
| 2,263,327 | 8/1941 | Bjerke et al. . | |
| 3,569,666 | 3/1971 | Murphy | 2/159 X |
| 4,195,365 | 4/1980 | Eyman et al. . | |
| 4,416,026 | 11/1983 | Smith | 2/161.6 |
| 4,519,097 | 5/1985 | Chappell, Jr. et al. . | |
| 4,561,122 | 12/1985 | Stanley et al. . | |
| 4,723,324 | 2/1988 | Lassiter | 2/161.6 X |
| 4,942,626 | 7/1990 | Stern et al. . | |
| 4,961,418 | 10/1990 | McLaurin-Smith | 2/164 X |
| 4,964,174 | 10/1990 | Martin . | |
| 5,650,225 | 7/1997 | Dutta et al. | 2/167 X |

OTHER PUBLICATIONS

Henderson Aquatics, Inc.—Catalogue, pp. 4&7, Millville, NJ, USA.

Overton's—Catalogue, pp. 80, 116 & 137; 1996.

*Primary Examiner*—C. D. Crowder

*Assistant Examiner*—Shirra L. Jenkins

*Attorney, Agent, or Firm*—James J. Murtha; Thomas A. Lennox

[57] ABSTRACT

A molded work glove for providing protection to the hand and fingers of a wearer against cold and abrasion is provided. A hand portion is made of a sheet foam material having a thickness between 1 mm and 5 mm. A hand cavity is disposed in the hand portion and is defined by the sheet foam material. Finger portions are mounted to the periphery of the hand portion and extend outwardly. The finger portions have a palm side and a back side and a tip located distal to the hand portion. The finger portions are made of a sheet foam material having a thickness between 1 mm and 5 mm. Finger cavities are disposed in the finger portions and are defined by the sheet foam material. The sheet foam material is an elastic, nonabsorbent, insulating material. The finger cavity at the tip is sized to loosely fit the finger of the wearer such that a gap is formed between the finger of the wearer and the sheet foam material. At least one aperture is disposed in the palm side at the tip of at least three finger portions. The aperture is sized to allow the fingers of the wearer to selectively pass through the apertures and be seated in the apertures in a snug fit.

20 Claims, 6 Drawing Sheets

WORK GLOVES

BACKGROUND OF THE INVENTION

This invention is related to the field of gloves. More particularly, the invention is directed to an insulated work glove which provides selective exposure of finger tips and protection against heat, cold and abrasion.

Gloves and mittens have been worn throughout history to keep hands warm in cold weather and to protect hands from abrasions while working. When the material of the glove is thicker, it provides better protection against cold and abrasions. The human hand, however, moves in complex ways. Humans rely on the sensitive touch of their fingers and their hands to identify and control objects. The subtle environmental clues normally detected by the hands are lost when wearing gloves because the fingers are covered. This problem is exacerbated as the glove material is made thicker. This lack of touch sensitivity is at best annoying and at worst dangerous, such as when working with machinery which requires precise control.

Various gloves have been developed over the years to address to various needs of different glove wearers. To permit greater tactile sensitivity, the tips of the finger stalls have been removed. While exposing the finger tips for gripping, they are also exposed to the cold weather. Further, these openings permit fluids to enter the glove which can waterlog the glove material, making it heavy and uncomfortable, as well as reducing the insulation afforded by the glove material.

Gloves are often worn in environments which are wet. The water (or other liquid) contacting the glove can reduce the insulating property of the glove as well as destroy the material of the glove. This is particularly true of gloves made of natural materials. Consequently, it is often desirable (but not always possible) that the wearer avoid contact with water while wearing gloves.

Various materials, from animal fur and leathers to synthetic fabrics, as well as combinations of these materials, have been employed to achieve warmth for the hands, to protect the hands against abrasions and to allow dexterity of movement. These materials each have varying attributes and can be employed at variable costs. Gloves made of these materials have achieved different levels of success depending on the intended task for the gloves. However, no known glove has been found which can provide the level of protection from extreme temperatures and abrasion, particularly in a wet environment, while permitting the dexterity and sensitivity allowed by the current invention.

U.S. Pat. No. 4,942,626 is directed to a needle stick protective glove for use by medical personnel which is adapted to prevent accidental injuries when handling needles. A first discrete layer of the glove is made of a flexible material which has a pore size smaller than the diameter of the needle. An opening is formed at the finger tip of at least the index and middle finger. A second discrete layer, which also has a pore size smaller than the diameter of the needle, is permanently attached to the first layer and covers the thumb stall and the sides of the index finger stall and middle finger stall. This glove does not include insulation that is designed to protect against the cold.

U.S. Pat. No. 4,195,365 is directed to a glove especially suitable for skydiving and aquatic activity. Webbing connects the adjacent finger stalls. A plurality of apertures are randomly disposed about the glove body surface for added comfort and to permit easy removal of the glove from the hand. Apertures are positioned at the tips of the finger stalls.

Due to the large number of openings, this glove provides little protection against the cold.

U.S Pat. No. 2,242,318 is directed to gloves and mittens in which holes are provided at the palm and the finger stalls to improve the wearer's grip. The holes in the finger stalls are disposed at the base of the finger stalls, near the palm, rather than at the tip. While designed to protect against the cold, the location of the holes expose the palm and the base of the fingers, areas subject to abrasion when gripping an object.

U.S. Pat. Nos. 4,519,097 and 4,561,122 are directed to gloves which permit increased tactile sensitivity by removing the tips of the finger stalls completely. The gloves disclosed therein include padding for shock absorption but do not disclose provision of protection against the cold.

U.S. Pat. Nos. 2,335,320; 2,263,327 and D106,139 are directed to gloves which expose the fingernails of the wearer. The fingertips of the stall include a clear portion or may include a hole through which the nail is visible.

None of these prior art device solve the problems addressed by the current invention.

SUMMARY OF INVENTION

It is an object of an aspect of the present invention to provide a glove which delivers insulation against the cold and protection against abrasion while allowing the wearer great tactile sensitivity in her fingers.

It is another object of an aspect of the invention to provide a glove which permits the wearer to selectively extend her finger tips from within the finger stalls for greater sensitivity and retract them back into the finger stalls for greater protection.

It is another object of an aspect of the invention to provide a glove with apertures in the finger stalls to permit the entrance of fluids, such as water, into the glove such that the water is maintained between the wearer's skin and the glove material, forming another insulating barrier between the wearer's hand and the environment.

In accord with one aspect of the invention, a molded work glove for providing protection to the hand and fingers of a wearer against cold and abrasion is provided. A hand portion is made of a sheet foam material having a thickness between 1 mm and 5 mm. A hand cavity is disposed in the hand portion and is defined by the sheet foam material. Finger portions are mounted to the periphery of the hand portion and extend outwardly. The finger portions have a palm side and a back side and a tip located distal to the hand portion. The finger portions are made of a sheet foam material having a thickness between 1 mm and 5 mm. Finger cavities are disposed in the finger portions and are defined by the sheet foam material. The sheet foam material is an elastic, nonabsorbent, insulating material. The finger cavity at the tip is sized to loosely fit the finger of the wearer such that a gap is formed between the finger of the wearer and the sheet foam material. At least one aperture is disposed in the palm side at the tip of at least three finger portions. The aperture is sized to allow the fingers of the wearer to selectively pass through the apertures and be seated in the apertures in a snug fit.

Certain implementations of this aspect of the invention provide that: the finger portions include a thumb portion, an index finger portion and a middle finger portion and the apertures are disposed only in the palm sides of the tips of the thumb portion, the index finger portion and the middle finger portion; the sheet foam material has a thickness of about 3 mm; the sheet foam material is neoprene; the sheet foam material has a thickness between 1.5 mm and 3.5 mm; a piping is disposed at the edges of the aperture which piping is composed of a non abrasive material; the sheet foam material comprises an elastic, nonabsorbent insulating foam core covered with a fabric material.

In accord with another aspect of the invention, a work glove for providing protection to the hand and fingers of a wearer is provided. A hand portion is made of a sheet foam material having a thickness between 1 mm and 5 mm. A hand cavity is disposed in the hand portion. The hand cavity is defined by the sheet foam material. Finger portions are mounted to the periphery of the hand portion and extend outwardly. The finger portions have a palm side and a back side and a tip distal to the hand portion. The finger portions are made of a sheet foam material having a thickness between 1 mm and 5 mm. Finger cavities are disposed in the finger portions and are defined by the sheet foam material. At least one aperture is disposed in the palm side at the tip of at least one finger portion. The aperture is sized to allow the finger of the wearer to selectively pass through the aperture.

Certain implementations of this aspect of the invention provide that: the sheet foam material is an elastic, nonabsorbent insulating material; the finger portions include a thumb portion, an index finger portion and a middle finger portion and the apertures are disposed only in the palm sides of the tips of the thumb portion, the index finger portion and the middle finger portion; the sheet foam material has a thickness between 1.5 mm and 3.5 mm; the sheet foam material has a thickness of about 3 mm; a piping is disposed at the edges of the aperture; the finger cavity at the tip is sized to loosely fit the finger of the wearer such that a gap is formed between the finger of the user and the sheet foam material; the sheet foam material comprises a foam layer surrounded by a fabric.

In accord with another aspect of the invention, a molded work glove for providing protection to the hand and fingers of a wearer is provided. A hand portion is made of a hand sheet material. A hand cavity is disposed in the hand portion and is defined by the hand sheet material. Finger portions are mounted to the periphery of the hand portion and extend outwardly. The finger portions have a palm side and a back side and a tip distal to the hand portion. The finger portions are made of a finger sheet material having a thickness between 1 mm and 5 mm. Finger cavities are disposed in the finger portions and are defined by the finger sheet material. At least one aperture is disposed in the palm side at the tip of at least one finger portion. The aperture is sized to allow the finger of the wearer to selectively pass through the aperture and be retained in the aperture.

Certain implementations of this aspect of the invention provide that: the finger sheet material is an elastic, insulating material; the hand sheet material is thicker than the finger sheet material; the aperture is sized such that, when the finger extends through the aperture, the finger is retained in a snug fit in the aperture; the finger sheet material is a nonabsorbent foam; the finger sheet material is neoprene.

DESCRIPTION OF PREFERRED EMBODIMENTS

Figure 6:
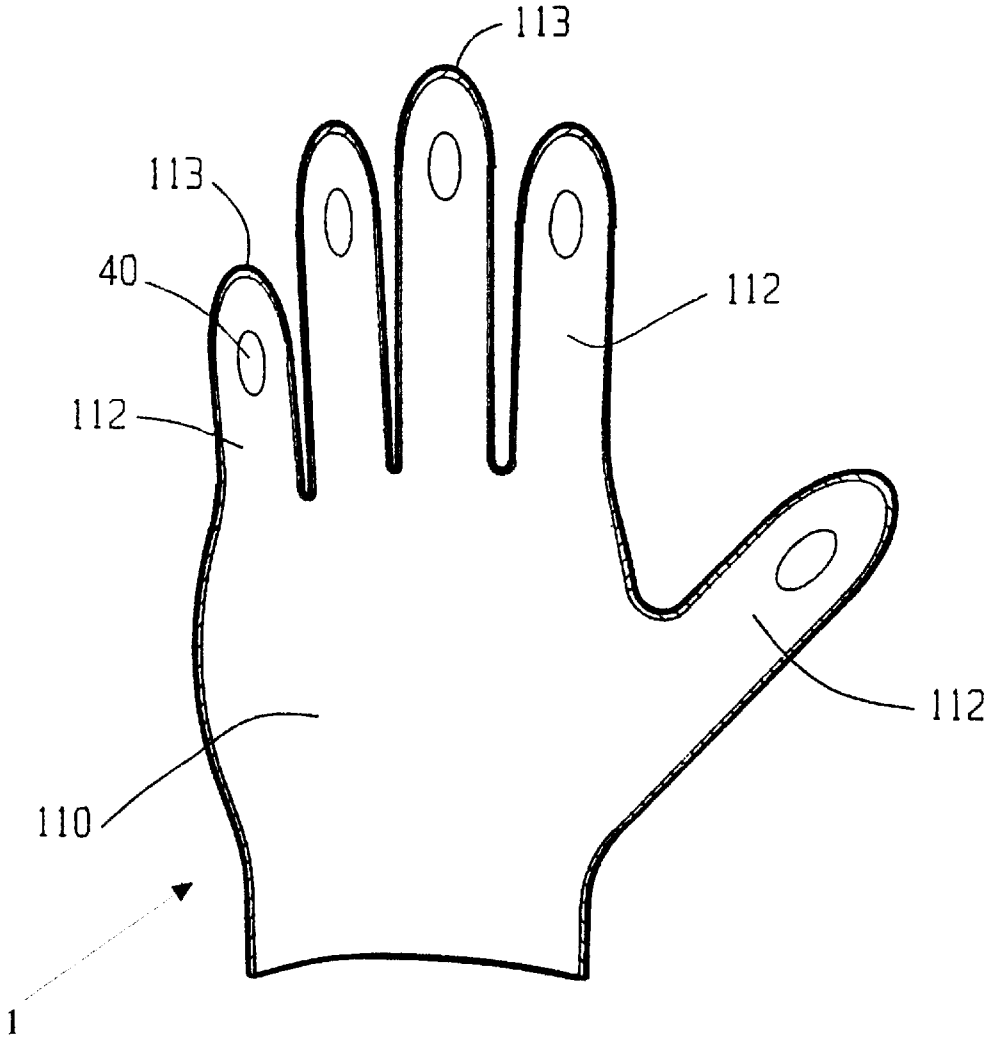
FIG. 6 is a cut-away rear view of the glove of FIG. 1 showing the inside of the front panel.

Referring to the drawings, a work glove 1 is shown. The glove includes a hand portion 10 and finger portions or stalls 12*a*, 12*b*, 12*c*, 12*d*, and 12*e*. A hand cavity 110 (see FIG. 6) is disposed within the hand portion and is sized to receive the hand of a user in a snug fit. Similarly, the finger portions contain finger cavities 112 sized to receive the fingers and the thumb of a user in a snug fit. The hand cavity and the finger cavities are designed not to be overly tight on the user's hand, which could create discomfort over long periods of wear. Further, near the tips 113, the finger cavities preferably provide a looser fit to the finger such that a gap 114 is created between the skin of the finger and the material of the glove. This loose fit may exist in the hand cavity and the entirety of the finger cavities, if desired.

The glove 1 includes a front panel 30 having a palm portion 31 and finger portions 32. A gripping surface may be provided on the front panel to improve the user's gripping ability. For example, rubber beads 33 may be attached to the front panel. These beads may be flat, having a diamond shape, a circular shape or another shape. The beads may protrude slightly from the front panel, providing a different type of improved grip. Further, epoxy ridges may be added to the front panel, as is known in the art. Various different gripping surfaces may be employed depending on the intended application for the gloves, although it is not required to practice the invention.

Figures 5A, 5B, 5C, 5D, 5E:
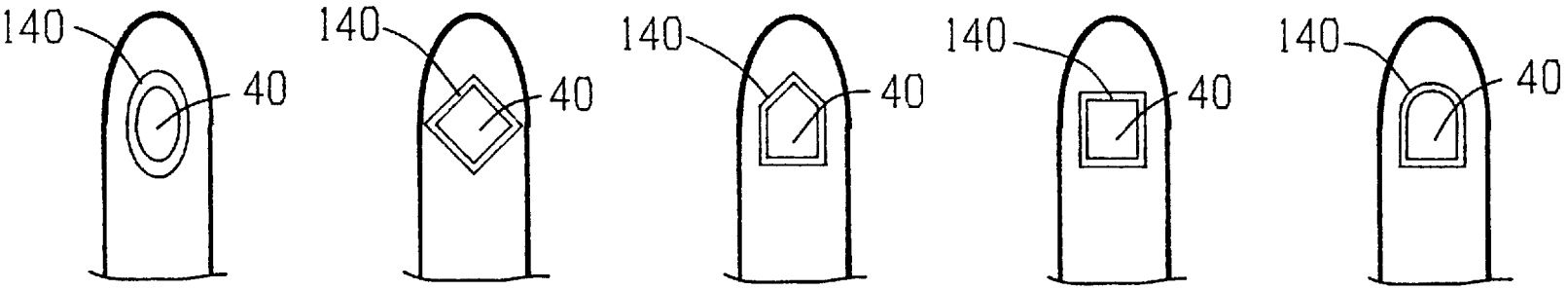
FIGS. 5A–5E are isolation views of apertures in the tips of stalls for the glove of FIG. 1.

Apertures 40 are disposed in the palm side 80 of the finger portions 32 of the front panel 30 at the tips 113 of the finger stalls 12*a*–12*e*. The back side 90 of the finger portions are solid. As currently preferred, apertures are provided in each of the finger stalls. However, apertures can be provided in any one or few of the stalls and practice the invention. In particular, apertures may be disposed only in the thumb stall 12*a*, the index finger stall 12*b* and the middle finger stall 12*c*. This construction would permit increased sensitivity for the fingers most relied on by the wearer but maintain the other fingers in closed stalls for greater protection The apertures 40 are preferably round or oval. Alternatively, the apertures may have a rectangular shape (see FIG. 5A), a diamond shape (see FIG. 5B), a pentagonal shape (see FIG. 5C), a square shape (see FIG. 5D), or an oval shape with a squared-off bottom (see FIG. 5E). of course, other shapes may be employed and still practice the invention, as one skilled in the art would appreciate. Additional surging, stitching or piping 140 may be provided to prevent the edges of the apertures from fraying and to increase the comfort of the wearer as her finger slides in and out of the aperture. The piping is preferably made of a non abrasive material.

Figure 1:
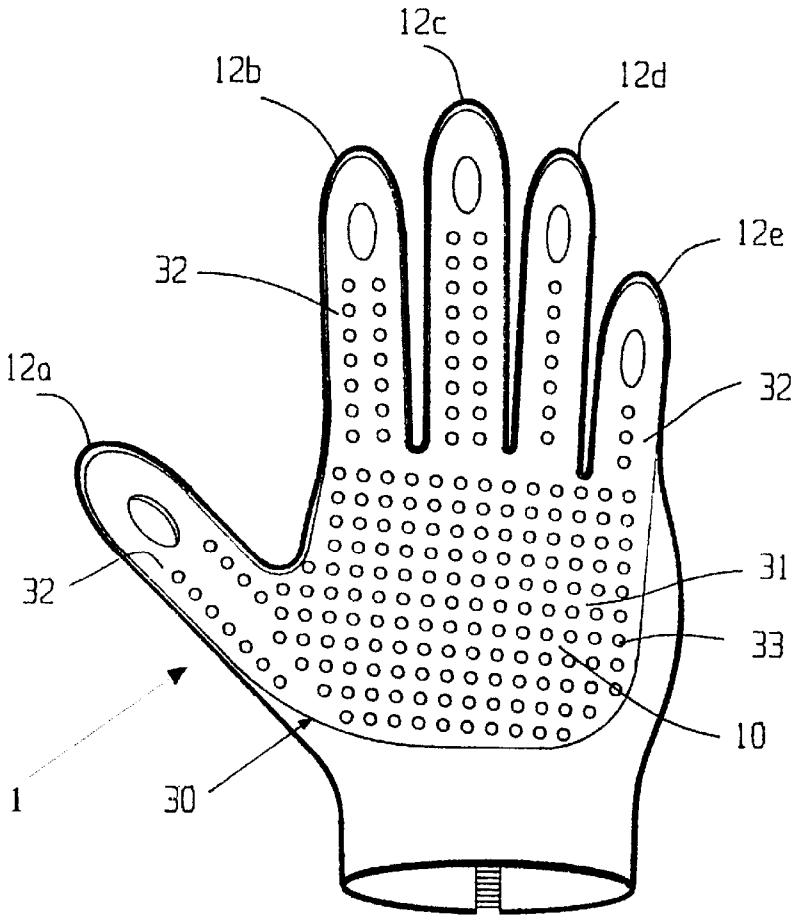
FIG. 1 is a front perspective view of a glove in accord with an aspect of the invention.
Figure 2:
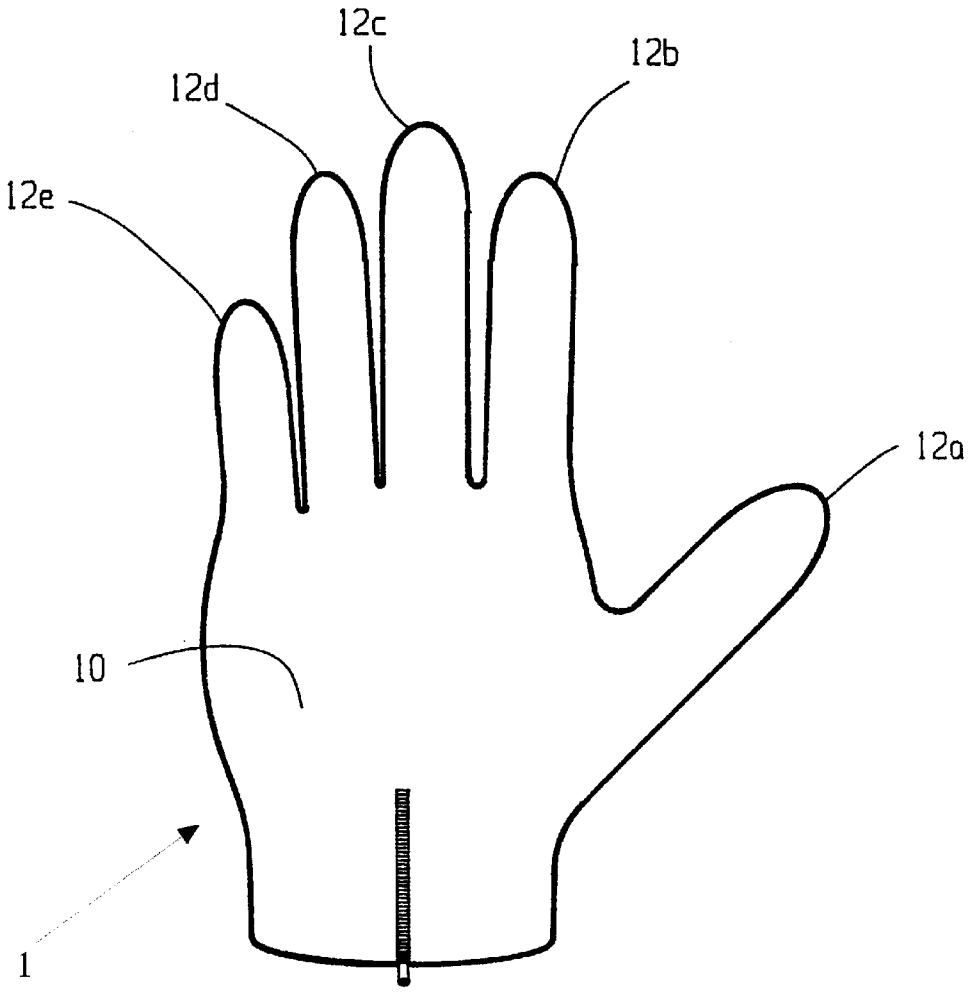
FIG. 2 is a rear perspective view of the glove of FIG. 1.
Figure 3:
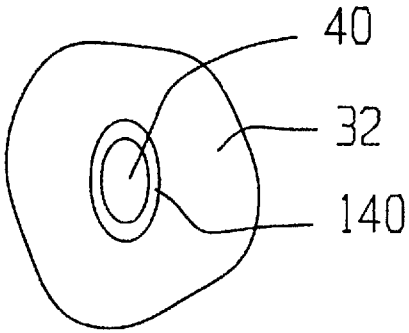
FIG. 3 is an isolation view of an aperture disposed in the glove of FIG. 1.
Figure 4:
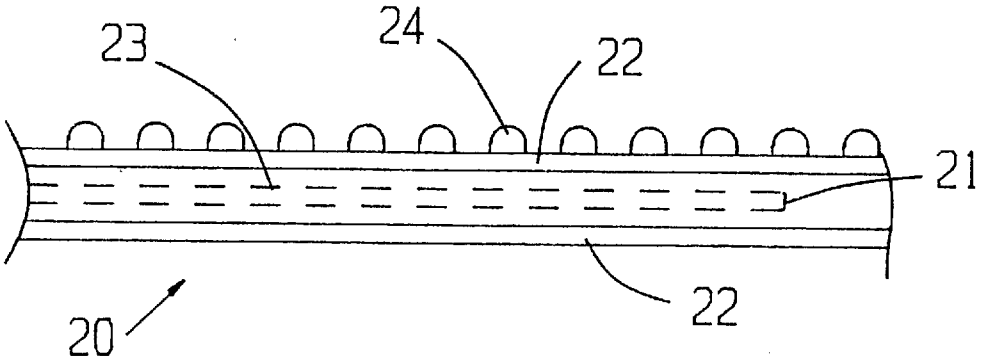
FIG. 4 is a cut-away side view of a sheet foam material for use with the glove of FIG. 1.

Referring specifically to FIG. 4, the glove 1 is composed of a sheet foam material 20 which is elastic, nonabsorbent and acts as an insulator. Preferably, the sheet material includes a closed cell foam core or layer 21 and is surrounded by thin sheets of fabric 22. By "closed cell," it is meant that the foam does not absorb substantial amounts of water. A heating element, such as heating coil 23 may be positioned in the foam layer 21. Alternatively, a self-heating gel pad may be attached to the glove. Further, various other heating means may be attached to the glove, as one skilled in the art would appreciate. A fleece liner 24 may be provided on the thin sheet of fabric 22, as seen in FIG. 4.

The sheet foam material 20 is flexible, allowing the hand to bend, but has a memory, such that it returns to its original shape. Preferably, the glove 1 is formed such that, in a rest condition, it is curved to approach the natural curve of a resting hand. The fabric 22 allows the skin on the hand and fingers to slide more easily over the surface of the glove without abrasing or irritating the skin. The foam core is preferably made of neoprene. Of course, other materials which are flexible and nonabsorbent, such as Goretex® from W. L. Gore Associates, Thinsulate® by 3M, and Polartec® by Malden Mills, may also be used and practice the invention. The fabric preferably is nylon, spandex or other such material.

The thickness of the sheet foam material 20 is critical. When the sheet foam material is too thick, it prevents the wearer from effectively moving his fingers. Further, this thickness results in a glove which is uncomfortable to wear. When the sheet foam material is too thin, it does not provide adequate protection against the cold. It has been found that the sheet foam material must have a thickness greater than 1 mm and less than 5 mm. Preferably, the sheet foam material has a thickness between 1.5 mm and 3.5 mm. Most preferably, the sheet foam material has a thickness of about 3mm. In certain applications, it may be desirable to provide a thicker layer of sheet foam material at the hand portion 10 of the glove than the finger portions 12. This provides more protection to the hand and allows more flexibility to the fingers. Further, it may be preferred to provide a layer of sheet foam material which is thicker at the back of the glove and thinner on the palm side.

Figure 7C:
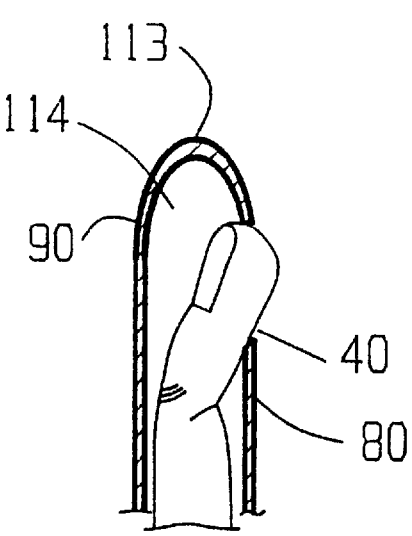
FIGS. 7A–7C are side views in partial cut-away showing a finger in the stall of the glove of FIG. 1.
Figure 7B:
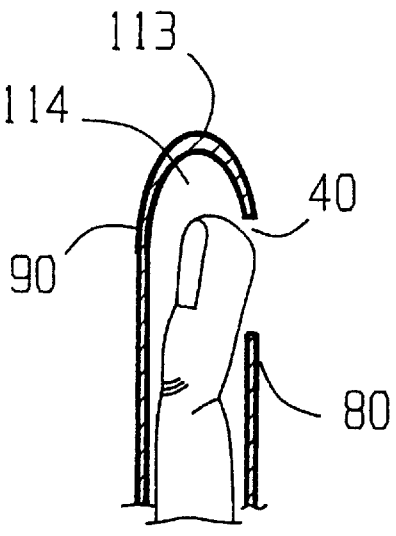
Figure 7A:
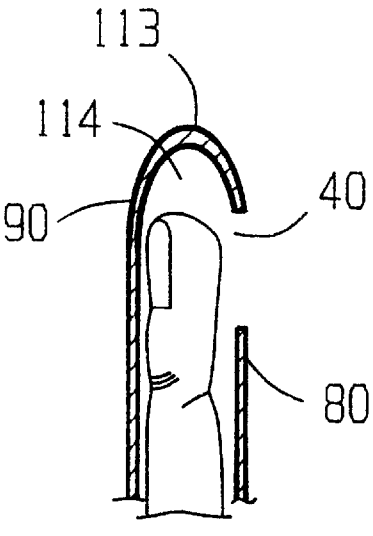

To use the gloves 1 of the present invention, the wearer slips her hand into the hand cavity 110 and her fingers into the finger cavities 112. The tips of the fingers are positioned within the stalls 12*a*–12*e* such that they are retained within the stalls but are proximate to the apertures, as shown in FIG. 7A. Due to the size of the apertures 40 and the relatively loose fit of the stalls 12*a*–12*e* to the finger tips, there is a gap 114 between the finger tip and the sheet foam material 20. The gap 114 contains air which creates a separate insulating layer around the skin of the wearer. A zipper 70 or other closing device may be provided to secure the glove to the hand in a snug fit.

Due to the size of the tip 113 of the finger portion 12 and the location of the apertures 40, the finger will normally be retained within the finger stall (see FIG. 7A). The apertures are sized to permit the finger tip to protrude slightly from the aperture if the user bends her finger (see FIG. 7B), allowing improved tactile sensations by directly touching an object. Further, due to the flexible nature of the sheet foam material, the user can push the entire head of the finger out of the aperture (see FIG. 7C), if desired, thereby permitting even better grip and agility. The aperture is sized such that the finger is seated snugly in the aperture when the finger is extended (or passed) through the aperture. When greater protection from the cold or abrasion is desired, the wearer can retract her finger completely into the stall, as shown in FIG. 7A.

The aperture 40 serves as a conduit from the exterior of the glove to the finger cavities. As discussed, this allows the finger tips to protrude out of the aperture, either partially or completely. The apertures 40 also permit water to pass into the finger cavities 112. Once in the cavities, the water is maintained between the sheet foam material 20 and the skin of the user. Due to the insulating property of the sheet foam material, the water is heated by the skin, thereby creating another layer of insulation around the skin. When the finger is in the aperture, a seal is created keeping the heated air or water in the gap 114 from escaping. Since the sheet foam material is a closed cell structure, the water is not absorbed by the sheet material. Consequently, the glove will not become waterlogged and heavy. Further, the glove can be easily dried when desired.

If a heating element is provided, the user may activate a battery pack worn on her arm or her waist. Alternatively, a thermo gel pad may be provided in the front or the back (or both) of the glove, creating additional heat. The foam layer may be designed such that it is thicker at the back side of the glove, thereby warming the hand but allowing the hand to bend easily.

While this invention has been described with reference to specific embodiments disclosed herein, it is not confined to the details set forth and the patent is intended to include modifications and changes which may come within and extend from the following claims.

We claim:

1. A molded work glove for providing protection to the hand and fingers of a wearer against cold and abrasion, the glove including:

a hand portion comprising a sheet foam material having a thickness between 1 mm and 5 mm, wherein a hand cavity is disposed in the hand portion and is defined by the sheet foam material;

finger portions mounted to the periphery of the hand portion and extending outwardly, the finger portions having a palm side and a back side and a tip located distal to the hand portion, wherein the finger portions comprise a sheet foam material having a thickness between 1 mm and 5 mm, and wherein finger cavities are disposed in the finger portions and are defined by the sheet foam material;

wherein the sheet foam material is an elastic, nonabsorbent, insulating material;

wherein the finger cavity at the tip is sized to loosely fit the finger of the wearer such that a gap is formed between the finger of the wearer and the sheet foam material;

wherein at least one aperture is disposed in the palm side at the tip of at least three finger portions, which aperture is sized to allow the fingers of the wearer to selectively pass through the apertures outside the finder portions and be seated in the apertures in a snug fit and wherein the aperture permits fluids to pass into the gap.

2. The glove of claim 1 wherein the finger portions include a thumb portion, an index finger portion and a middle finger portion and wherein apertures are disposed only in the palm sides of the tips of the thumb portion, the index finger portion and the middle finger portion.

3. The work glove of claim 1 wherein the sheet foam material has a thickness of about 3 mm.

4. The work glove of claim 3 wherein the sheet foam material is neoprene.

5. The work glove of claim 1 wherein the sheet foam material is thicker at the back side than the palm side.

6. The work glove of claim 5 further comprising a piping disposed at the edges of the aperture which piping is composed of a non abrasive material.

7. The work glove of claim 6 further comprising a fleece material mounted to one side of the sheet foam material.

8. A work glove for providing protection to the hand and fingers of a wearer comprising:

a hand portion comprising a non-absorbent sheet foam material, wherein a hand cavity is disposed in the hand portion and the hand cavity is defined by the sheet foam material;

finger portions mounted to the periphery of the hand portion and extending outwardly, the finger portions having a palm side and a back side and a tip distal to the hand portion, wherein the finger portions comprise a non-absorbent elastic sheet foam material having a thickness between 1 mm and 5 mm, and wherein finger cavities are disposed in the finger portions and are defined by the sheet foam material;

wherein at least one aperture is disposed in the palm side at the tip of at least one finger portion, which aperture is sized to allow the finger of the wearer to selectively pass through the aperture and to allow water to pass into the finger portions.

9. The work glove of claim 8 wherein the sheet foam material is an elastic, nonabsorbent insulating material having a thickness between 1 mm and 5 mm.

10. The work glove of claim 9 wherein the sheet foam material has a thickness between 1.5 mm and 3.5 mm.

11. The glove of claim 10 wherein the sheet foam material is neoprene.

12. The work glove of claim 9 wherein the finger cavity at the tip is sized to loosely fit the finger of the wearer such that a gap is formed between the finger of the user and the sheet foam material.

13. The work glove of claim 12 further comprising a heating element attached to the sheet foam material.

14. The work glove of claim 13 further comprising a piping disposed at the edges of the aperture.

15. The work glove of claim 9 wherein the sheet foam material comprises a foam layer surrounded by a fabric and wherein a gripping surface is mounted to the hand portion.

16. A molded work glove for providing protection to the hand and fingers of a wearer comprising:

a hand portion comprising a hand sheet material, wherein a hand cavity is disposed in the hand portion and is defined by the hand sheet material;

finger portions mounted to the periphery of the hand portion and extending outwardly, the finger portions having a palm side and a back side and a tip distal to the hand portion, wherein the finger portions comprise an elastic finger sheet material having a thickness between 1 mm and 5 mm, and wherein finger cavities are disposed in the finger portions and are defined by the finger sheet material;

wherein at least one aperture is disposed in the palm side at the tip of at least one finger portion, which aperture is sized to allow the finger of the wearer to selectively pass through the aperture and be retained in the aperture and wherein the aperture permits fluids to pass into the tip; and wherein the finger sheet material is an elastic, insulating sheet foam material.

17. The work glove of claim 16 wherein the hand sheet material is thicker than the finger sheet material.

18. The work glove of claim 16 wherein the aperture is sized such that, when the finger extends through the aperture, the finger is retained in a snug fit in the aperture.

19. The work glove of claim 18 wherein the finger sheet material is a nonabsorbent foam.

20. The work glove of claim 19 wherein the finger sheet material is neoprene.

* * * * *